United States Patent [19]

Nagano et al.

[11] 3,932,271

[45] Jan. 13, 1976

[54] ELECTRIC PRECONDITIONING IN SELECTIVE FLOTATION OF OXIDIC TYPE ORES

[75] Inventors: Ikuo Nagano, Hino; Kozo Saitoh, Tokyo; Hiroshi Tanaka, Chofu, all of Japan

[73] Assignee: Mitsui Mining & Smelting Co., Ltd., Tokyo, Japan

[22] Filed: Jan. 9, 1974

[21] Appl. No.: 431,927

[30] Foreign Application Priority Data

Jan. 13, 1973 Japan ..... 48-006781

[52] U.S. Cl. ..... 209/9; 209/165; 209/167

[51] Int. Cl.[2] ..... B03B 1/00

[58] Field of Search ..... 209/166, 167, 9, 164, 1, 209/162, 164, 2, 3, 163, 165; 204/130, 92

[56] References Cited

UNITED STATES PATENTS

| | | | |
|---|---|---|---|
| 554,914 | 2/1896 | Dimmick | 209/9 X |
| 1,126,965 | 2/1915 | Emerson | 209/164 |
| 1,891,776 | 12/1932 | O'Malley | 209/167 X |
| 2,084,316 | 7/1936 | Beatty | 209/164 |
| 2,258,507 | 10/1941 | Moas | 209/166 |
| 3,745,102 | 7/1973 | Banerji | 204/92 X |

FOREIGN PATENTS OR APPLICATIONS

| | | | |
|---|---|---|---|
| 398,058 | 3/1921 | Germany | 209/164 |
| 477,950 | 2/1927 | Germany | 209/164 |
| 505,059 | 5/1920 | France | 209/9 |
| 914,067 | 12/1962 | United Kingdom | 209/164 |
| 194,679 | 6/1967 | U.S.S.R. | 204/130 |
| 78,111 | 2/1932 | Sweden | 209/166 |

OTHER PUBLICATIONS

Chem. Abst., 78, 1973, 1389842.

*Primary Examiner*—Robert Halper

*Attorney, Agent, or Firm*—Woodhams, Blanchard and Flynn

[57] ABSTRACT

In the flotation of oxide ores, a method of flotation characterized by applying d-c current to the oxide ore slurry as a pre-treatment prior to flotation.

9 Claims, 3 Drawing Figures

ELECTRIC PRECONDITIONING IN SELECTIVE FLOTATION OF OXIDIC TYPE ORES

BACKGROUND OF THE INVENTION

1. Field of the Invention

The present invention relates to a flotation method for oxide ores in which the ore is pre-treated by electric current prior to undergoing flotation.

2. Description of the Prior Art

In general, the separation efficiency of flotation is accomplished by the selective chemical and physical actions under certain conditions between various mineral processing reagents and the surfaces of the various minerals. Suitable flotation techniques for the so-called sulfide ores have been established to a certain degree.

However, when the surface properties of the constituents of various mixed ores such as oxide ore and non-metallic ore closely resemble each other, it is extremely difficult to achieve an effective separation, even if prior to the flotation, various techniques such as pH adjustment, temperature adjustment and addition of mineral processing reagents have been employed.

For example, in the flotation of zinc oxide from silicate minerals, it is known to effect sulfidization of said minerals with $Na_2S$ with heating and then utilizing cationic collectors. But this method has many defects such as the need to deslime the minerals before the flotation, as well as the need to heat and add a large amount of reagent to the slurry during operation, and the flotation result is poor.

SUMMARY OF THE INVENTION

We have investigated to find flotation methods which do not have the above defects. We have paid attention to the facts that ores in the slurry state have surface electric potentials which vary depending on the kinds of coexisting ions or pH value, and that these variations change the response characteristics of the ores as regards various mineral processing reagents. We have discovered that desirable response characteristics, which could not have been achieved by the prior art techniques, can be obtained by means of applying d-c current to the slurry and thereby causing the surface electric potentials to change. The present invention has been obtained on the basis of this discovery. According to this invention the flotation of the oxide ores can be effectively achieved by applying d-c current to the slurry, as a pre-treatment, prior to flotation.

An object of this invention is to provide a method for the flotation of oxide ores which is capable for carrying out effectively the mutual separation of the ore constituents.

Another object of this invention is to provide a flotation method for oxide ores which facilitates control of the flotation for separating the ore constituents.

A further object of this invention is to provide a non-polluting flotation method which does not use the toxic agents and is economically advantageous.

In the present invention, the surface electric potential of the ores can be varied by altering the combination of conditions of electrode material, voltage, d-c current and electric conditioning agent. As the result the flotation adjustment, which has been most difficult by the prior art techniques, now can be done easily.

DETAILED DESCRIPTION OF THE INVENTION

The flotation method according to the present invention makes it possible to obtain broad variations of the flotation properties of the ore materials by varying the electric conditions such as the electrode materials and the electric conditioning time, which are applied to the slurry prior to flotation.

The differences in the various electric conditions that change the flotation properties will be described by referring to the accompanying drawings.

Figure 1:
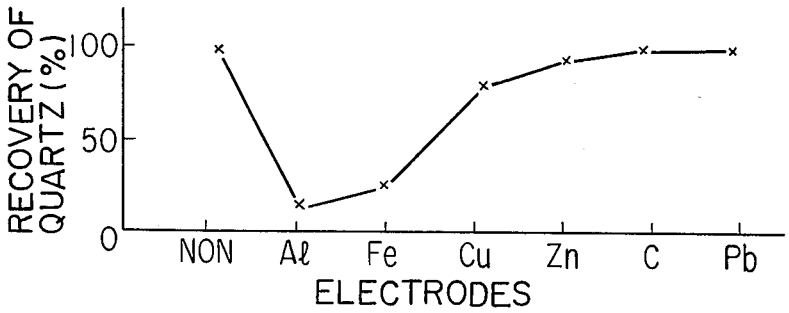
FIG. 1 is a graph showing the variation of recovery percentage of quartz using various electrode materials.
Figure 2:
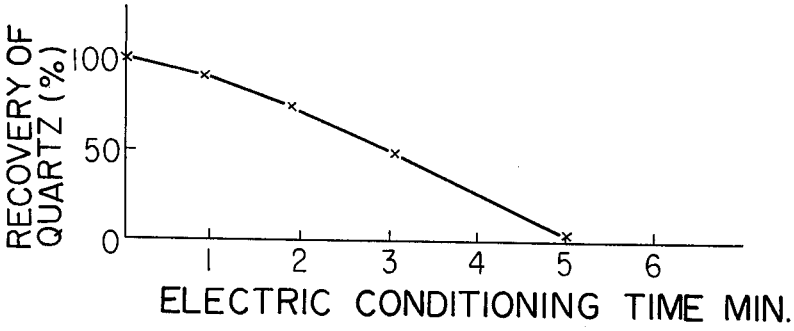
FIG. 2 is a graph showing the variation of recovery percentage of quartz in relation to the electric conditioning time.
Figure 3:
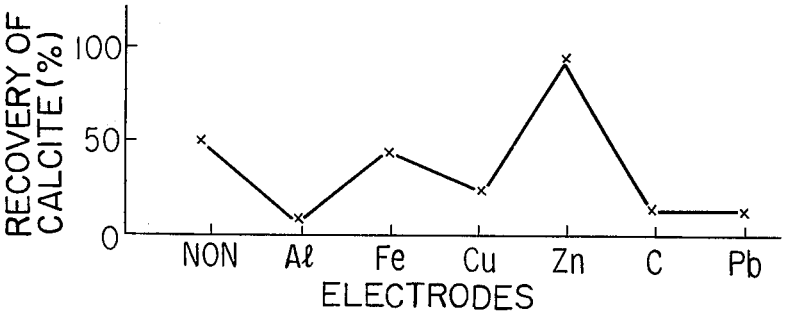
FIG. 3 is a graph showing the variation of recovery percentage of calcite using on the same electrode materials as FIG. 1.

In the experiments whose results are graphically illustrated in FIGS. 1–3, the purity of the quartz and calcite is very good, and the collector is cationic Armac C (Armour Industrial Chemical Co.) and the frothing agent is Nikko No. 10 oil (Nippon Koryo KK). In the experiments, a small laboratory flotation cell was used and the cell and the agitator were electrically insulated. Then electrodes were inserted in the cell, and d-c current was applied to the ore slurry, following which the flotation was carried out.

In the experiments of FIGS. 1 and 3, the flotation conditions, d-c voltage, d-c current, electric conditioning time and electric conditioning agent were the same, except for changing the electrode material. In the experiments of FIG. 2, the flotation conditions, d-c voltage, d-c current, electric conditioning agent and electrode material were the same, except for changing the electric conditioning time. The symbol "non" on the abscissa of the FIGS. 1 and 3 shows that the flotation is carried out without electric conditioning.

From the graphs of FIGS. 1–3, it is observed that the electrode material and the electric conditioning time in the electric treatment according to the present invention have a considerable effect on the flotation characteristics. Consequently, as shown in the following Examples, for instance, in the flotation of metal-bearing ores containing silicates and/or alkaline carbonates, flotation can be carried out with high efficiency by suitably selecting and combining the conditions of the electrical conditioning pre-treatment according to the present invention so that the flotation of those ores is most depressed or is most promoted.

In the present invention, when the electric conditioning is carried out with stirring, the electrodes are inserted into a conditioner equipped with an electrically insulated agitator (which may be a circular type or an angular type). In the feed and discharge of the ore slurry or pulp in this case, there can be employed various combinations of conditioner upper surface feed, conditioner bottom surface feed conditioner upper surface discharge and conditioner bottom surface discharge.

On the other hand, when the electric conditioning is carried out without stirring, it is preferable that the electrodes are inserted into an electrically insulated conditioner, and the slurry is uniformly charged to the upper surface of the conditioner and is discharged from the bottom. The size of the conditioner is determined according to the time necessary for the electrical conditioning treatment.

The preferred optimum values of voltage and current for the electric conditioning treatment will vary depending on the particular ore treated. There is employed a current density of 0.002 to 20.0 A/dm² and a voltage of 0.5 to 750.0 volts. Suitable values within those ranges are selected, taking into consideration, such points as the amount of the electric conditioning agent added, the distance between the electrodes, the area of the electrodes and the electric conditioning time. For any specific ore, there will be carried out a series of routine experiments to determine the specific conditions that will provide the most economic recovery of a concentrate of the desired material.

The shape of the electrodes to be used in the present invention is not critical and it can be of any suitable form such as plate, stick, cylinder, lattice, and fiber. The electrode can be an electrode which will gradually be dissolved during the treatment, such as aluminum, nickel, copper, lead, zinc, iron, etc. or an insoluble electrode made of carbon, etc., or combinations thereof can be employed.

In the present invention, it is preferred to add to the ore slurry or pulp, prior to or during the electric conditioning, one or more electric conditioning agents. Suitable elecrical conditioning agents include hydroxides such as KOH, NaOH, $Ca(OH)_2$, $Zn(OH)_2$, $NH_4OH$, etc., acids such as $H_2SO_4$, $HNO_3$, $CH_3COOH$, HCl, $H_2C_2O_4$ and their metal salts, etc. Halogenides of the alkali metals or alkaline earth metals are especially preferred.

The joint use of one or more electric conditioning agents with conventional flotation agents, for instance, dispersing agents, regulating agents, activating agents, pressing agents, etc., also is effective.

As stated above, the present invention provides an electric conditioning pre-treatment to change the electric charge of the surface of the ore particles by applying d-c current into the slurry. This change of the electric charge of the surface in the dispersed phase or solution consisting of solid-liquid phase, can be applied to various other solid-liquid phase treatments, for example, sedimentation, flocculation, dispersion, floating, cleaning, separation, filtration, dehydration, emulsification, frothing, defrothing, rinsing, corrosion, wettability, degreasing, decomposition, solubilization, bleaching, fluidization, deodorizing, fungicide, dyeing, permeation, leaching, swelling, oxidation, slimecoating and the like.

By the use of the d-c current electrical conditioning treatment of the slurry by the present invention, ores that have not been used by the industry, because of the difficulty of concentrating them by flotation can be effectively recovered. Furthermore, the use of the method of the present invention is extremely effective for the recovery of underground resources because the efficiency of the flotation is improved in comparison with the conventional methods.

PREFERRED EMBODIMENTS OF THE INVENTION

In the following Examples, all "%", refer to percent by weight.

EXAMPLE 1

For the separation of zinc oxide ore (22.8% of zinc, 56% of $SiO_2$) which was difficult to separate by the conventional amine flotation method, the method of the present invention and the conventional method were applied, and the data shown in the following table were obtained:

Table 1

| | | Method of the present invention | | Conventional method | |
|---|---|---|---|---|---|
| Electrical Conditioning Treatment Conditions | | Aluminum electrode D.C. 27V, 1.0A/dm² Electric conditioning agent $CH_3COONa$ Electric Conditioning time 5 min. | | None | |
| Flotation Conditions | $Na_2S$ | None | | 10 Kg/t | |
| | Armac C | 230 g/t | | 230 g/t | |
| | Nikko No. 10 | 250 g/t | | 230 g/t | |
| | Flotation time | 15 min. | | 15 min. | |
| | pH | 8.3 | | 11.2 | |
| Results | | Zn assay % | Zn recovery % | Zn assay % | Zn recovery % |
| | Feed | 22.8 | 100.0 | 22.8 | 100.0 |
| | Froth | 43.1 | 90.1 | 23.8 | 92.9 |
| | Tailing | 4.3 | 9.9 | 14.7 | 7.1 |

The amine flotation method has been applied as a flotation method for the ore used in Example 1, but, even if a large amount of 10 kg/t of $Na_2S$ is used, the separation is not substantially carried out. However, when the electric conditioning treatment by the present invention is carried out, the separation performance is remarkably improved.

EXAMPLE 2

For the separation of zinc oxide ore containing a large amount of calcite (22.2% of zinc, 28% of CaO), the method of the present invention and the conventional method were applied and the data shown in the following table were obtained:

Table 2

| | Method of the present invention | Conventional method |
|---|---|---|
| Electrical Conditioning Treatment Conditions | Lead electrode D.C. 35V, 1.5A/dm² Electric conditioning agent KCl | None |

Table 2-continued

| | | Electric conditioning time 7 min. | | | |
|---|---|---|---|---|---|
| Flotation conditions | $Na_2S$ | None | | 10 Kg/t | |
| | Armac C | 225 g/t | | 150 g/t | |
| | Nikko No. 10 | 190 g/t | | 190 g/t | |
| | Flotation time | 15 min. | | 15 min. | |
| | pH | 8.9 | | 11.3 | |
| | | Zn assay % | Zn recovery % | Zn assay % | Zn recovery % |
| Results | Feed | 22.2 | 100.0 | 22.2 | 100.0 |
| | Froth | 41.8 | 79.7 | 30.3 | 95.8 |
| | Tailing | 7.8 | 20.3 | 3.1 | 4.2 |

The flotation of the ore used in Example 2 has heretofore been most difficult, and has not substantially been successful yet. The "conventional method" in said Table was carried out for comparison with the method of the present invention.

EXAMPLE 3

For the flotation of zinc oxide ore containing a large amount of kaolin (Zn 21.9%, kaolin 50%), the method of the present invention and the conventional method were applied and the results shown in the following table were obtained:

Table 3

| | | Method of the present invention | | Conventional method | |
|---|---|---|---|---|---|
| Electrical Conditioning Treatment Conditions | | Aluminum electrode D.C. 18V, 1.5A/dm² Electric conditioning agent NaCl Electric conditioning time 9 min. | | None | |
| Flotation conditions | $Na_2S$ | None | | 10 Kg/t | |
| | Armac C | 800 g/t | | 190 g/t | |
| | Nikko No. 10 | 750 g/t | | 250 g/t | |
| | Flotation time | 30 min. | | 15 min. | |
| | pH | 8.1 | | 10.6 | |
| | | Zn assay % | Zn recovery % | Zn assay % | Zn recovery % |
| Results | Feed | 21.9 | 100.0 | 21.9 | 100.0 |
| | Froth | 8.8 | 19.1 | 26.5 | 98.0 |
| | Tailing | 34.5 | 80.9 | 2.3 | 2.0 |

The flotation of the ore used in Example 3 has also been difficult, similar to that of the ore used in Example 2, and it has not been successful in practice. In accordance with the method of the present invention, the flotation can be extremely easily and preferably carried out.

EXAMPLE 4

For the concentration of manganese oxide ore containing silica (21.2% of Mn, 46% of silica) as gangue material, the method of present invention and the conventional method were applied and the data shown in the following table were obtained:

Table 4

| | | Method of the present invention | | Conventional method | |
|---|---|---|---|---|---|
| Electrical Conditioning Treatment Conditions | | Aluminum electrode D.C. 35V, 1.0A/dm² Electric conditioning agent LiCl Electric conditioning time 10 min. | | None | |
| Flotation conditions | | Armac C | 250 g/t | ACC No. 3037 | 300 g/t |
| | | Nikko No.10 | 225 g/t | Kerosene | 100 g/t |
| | | Flotation time | 7 min. | Nikko No.10 | 100 g/t |
| | | | | Armac C | 50 g/t |
| | | pH | 8.2 | Flotation time | 20 min. |
| | | Mn assay % | Mn recovery % | Mn assay % | Mn recovery % |
| Results | Feed | 21.2 | 100.0 | 21.2 | 100.0 |
| | Froth | 10.2 | 17.7 | 15.9 | 38.7 |
| | Tailing | 30.5 | 82.3 | 26.8 | 61.3 |

The flotation of the ore used in Example 4 is an example in which manganese is desired to be concentrated in the tailing. The conventional methods have not been able to improve the assay above 30%. However, the method of the present method can improve the assay above 30% and the recovery.

EXAMPLE 5

For the separation of non-metallic ore (50% of $SiO_2$, 50% of $CaCO_3$), the method of present invention and the conventional method were applied and the data shown in the following table were obtained.

Table 5

| | | Method of the present invention | | Conventional method | |
|---|---|---|---|---|---|
| Electrical Conditioning Treatment Conditions | | Carbon electrode D.C. 12V, 0.6A/dm² Electric conditioning agent NaCl and $PbSO_4$ Electric conditioning time 11 min. | | None | |
| | Flotation Condition | | | | |
| | Armac C | 250 g/t | | 250 g/t | |
| | Nikko No. 10 | 625 g/t | | 625 g/t | |
| | Flotation time | 5 min. | | 5 min. | |
| | pH | 7.5 | | 8.1 | |
| | | $SiO_2$ assay % | $SiO_2$ recovery % | $SiO_2$ assay % | $SiO_2$ recovery % |
| Results | Feed | 50.0 | 100.0 | 50.0 | 100.0 |
| | Froth | 92.0 | 70.5 | 57.3 | 97.4 |
| | Tailing | 24.0 | 29.5 | 8.7 | 2.6 |

The embodiments of the invention in which an exclusive property or privilege is claimed are defined as follows:

1. A method of ore separation which comprises: electrically preconditioning an ore pulp containing mixed oxide ore particles selected from the group consisting of (1) mixtures of zinc oxide and silica, (2) mixtures of zinc oxide and calcium oxide, (3) mixtures of zinc oxide and kaolin, (4) mixtures of manganese oxide and silica and (5) mixtures of silica and calcium carbonate, by applying DC current to said ore pulp from electrodes inserted in said pulp, at a current density of from 0.002 to 20 A/dm² and at a voltage of from 0.5 to 750 V, for a period of time effective to change the surface electric potentials of the ore particles to alter their flotation characteristics to improve the flotability of zinc oxide in the case of mixtures (1) and (2), to depress the flotability of zinc oxide in the case of mixture (3), to depress the flotability of manganese oxide in the case of mixture (4), and to improve the flotability of silica in the case of mixture (5), and to improve their separation characteristics; discontinuing application of said DC current and then subjecting said electrically preconditioned pulp to froth flotation in a flotation cell, and recovering from the flotation cell a concentrate of zinc oxide in the case of mixtures (1), (2) and (3), manganese oxide in the case of mixture (4), and silica in the case of mixture (5).

2. The method of claim 1, in which an electric conditioning agent is added to said ore pulp prior to or during application of said DC current.

3. The method of claim 2, in which said electric conditioning agent is selected from the group consisting of KOH, NaOH, $Zn(OH)_2$, $Ca(OH)_2$, $NH_4OH$, HCl, $H_2SO_4$, $HNO_3$, $H_2C_2O_4$ and $CH_3COOH$ and salts of the latter five acids.

4. The method of claim 1, in which the material of said electrodes is selected from Al, Fe, Cu, Zn, Pb, C, Ni and alloys thereof.

5. The method of claim 1, in which said ore pulp is a mixture of zinc oxide and silica, said electrodes are made of Al, and a concentrate of zinc oxide is recovered as the froth.

6. The method of claim 1, in which said ore pulp is a mixture of zinc oxide and calcium oxide, said electrodes are made of Pb, and a concentrate of zinc oxide is recovered as the froth.

7. The method of claim 1, in which said ore pulp is a mixture of zinc oxide and kaolin, said electrodes are made of Al, and a concentrate of zinc oxide is recovered as the tailings.

8. The method of claim 1, in which said ore pulp is a mixture of manganese oxide and silica, said electrodes are made of Al, and a concentrate of manganese oxide is recovered as the tailings.

9. The method of claim 1, in which said ore pulp is a mixture of silica and calcium carbonate, said electrodes are made of carbon, and a concentrate of silica is recovered as the froth.

* * * * *